United States Patent [19]

Inaba et al.

[11] Patent Number: 4,698,545

[45] Date of Patent: Oct. 6, 1987

[54] COLOR PICTURE TUBE HAVING A SHADOW MASK WITH A CR ENRICHED LAYER

[75] Inventors: Michihiko Inaba; Tetsuo Fujiwara, both of Yokohama; Masaharu Kanto, Hyogo; Yasuhisa Ohtake, Fukaya; Fumio Mori, Yokohama, all of Japan

[73] Assignee: Kabushiki Kaisha Toshiba, Kawasaki, Japan

[21] Appl. No.: 776,808

[22] Filed: Sep. 17, 1985

[30] Foreign Application Priority Data

Sep. 26, 1984 [JP] Japan ..... 59-201268
Mar. 27, 1985 [JP] Japan ..... 60-60937

[51] Int. Cl.[4] ..... H01J 29/07
[52] U.S. Cl. ..... 313/402; 313/407
[58] Field of Search ..... 313/402, 407; 75/126 H, 75/128 A, 128 B; 252/513; 445/47

[56] References Cited

U.S. PATENT DOCUMENTS 4,131,494 12/1978 Momose et al. ..... 75/128 B X

FOREIGN PATENT DOCUMENTS 0104453 4/1984 European Pat. Off. .
0125931 11/1984 European Pat. Off. .
2350366 4/1975 Fed. Rep. of Germany ..... 313/402
3124185 4/1982 Fed. Rep. of Germany .
50-58977 5/1975 Japan .
59-59861 4/1984 Japan .
59-173247 10/1984 Japan .
0211941 11/1984 Japan ..... 313/407

*Primary Examiner*—Palmer C. DeMeo
*Assistant Examiner*—Sandra L. O'Shea
*Attorney, Agent, or Firm*—Oblon, Fisher, Spivak, McClelland, & Maier

[57] ABSTRACT

Color picture tube in which a tube element, e.g., the shadow mask, is constituted by an Fe alloy to which 25–45 wt % of Ni and at least some Cr are added. A Cr rich layer is formed on the tube element surface and black oxide film with a spinel structure containing Cr is formed on the surface of this film.

9 Claims, 4 Drawing Figures

COLOR PICTURE TUBE HAVING A SHADOW MASK WITH A CR ENRICHED LAYER

BACKGROUND OF THE INVENTION

This invention relates to a colour picture tube that is constructed using a shadow mask, frame, inner shield and bimetal and other tube elements with good formability and excellent thermal characteristics and gives high displayed image quality.

A colour picture tube has electron guns, e.g., in an in-line array, in a neck portion formed at one end of a glass envelope and red, blue and green phosphors provided in an image-division array on a face portion at the other end of the glass envelope facing these electron guns. A shadow mask with a plurality of beam holes is placed near to and facing this fluorescent surface. As this shadow mask is made integral with a frame by welding around its periphery and the frame is mounted on a face portion via attachment elements including bimetal, the frame is further provided with an inner shield to shield against the effects of geomagnetism.

In a colour picture tube thus constructed, electron beams emitted by the electron guns are deflected by deflection control effected by a deflection device provided at the root portion of the neck portion and pass through holes in the shadow mask to strike the fluorescent surface and cause fluorescence and so define a coloured picture.

In the past, the materials used for shadow masks, frames and inner shields have been rimmed steel and Al killed steel, etc., which have good etchability and formability and on whose surfaces there is easily formed an oxide film that contributes to reduction of electron beam reflection. Recently, however, there have been demands for higher picture tube quality, i.e., for so-called good viewability and fine detail of displayed images, in order to meet the needs of new media and there have been found to be drawbacks in use of shadow masks, frames and inner shields that are made of rimmed steel and Al killed steel as noted above.

In more detail, the temperature of these elements rises to 30°–100° C. during operation of a colour picture tube and, for example, so-called doming occurs because of distortion of the formed shape of the shadow mask caused by its thermal expansion. As a result, misalignment in the positional relationship of the shadow mask and fluorescent screen occurs, so giving rise to colour fringing, or purity drift (PD). In high definition colour picture tubes in particular, there is a proportionally greater amount of misalignment since the shadow mask hole diameter and hole pitch are very small and tube elements as described above for which the material used is rimmed steel or Al killed steel become unserviceable for practical purposes. This problem is particularly apparent in high radius of curvature picture tubes in which the face portion and shadow mask are brought close to a plane in order to reduce image distortion and reflection of external light.

Use of Ni-Fe alloys, e.g., invar (36 Ni-Fe), with a small coefficient of thermal expansion as material for these tube parts or elements has been proposed in the past, e.g., in U.S. Pat. No. 4,420,366 (Oka et al.) but the heat conductivity of these Ni-Fe alloys is very poor and as well as there being liable to be accumulation of heat, there is liable to be so-called springback, or inward curving from the spherical surface of an ordinary shadow mask towards the electron gun end. There are also drawbacks in connection with etchability and formability, since when shadow mask holes are formed by etching there is liable to be unevenness of hole diameter, etc. Also, a blackening film formed on the surface as disclosed in Japanese Laid-open Patent Application No. 50-58977 is liable to peel off, so imposing limits on designs to upgrade colour picture tubes.

SUMMARY OF THE INVENTION

The object of the present invention is to provide a colour picture tube which can produce pictures of high quality and possesses tube elements that have a low coefficient of thermal expansion and good formability and effect excellent radiation of heat.

The invention is a colour picture tube which is provided with tube elements made of alloys with iron (Fe) as the main component and containing 25–45 wt % of nickel (Ni), these tube elements being Fe-Ni alloys which contain at least 0.3–10 wt % of chromium (Cr) and can be partially substituted by manganese (Mn) and whose surface are made Cr rich regions and have a black film on them.

The black film is an oxide of the abovenoted alloy and has a spinel structure.

The oxide of the black film is representable by the chemical formula $$Cr_xNi_y\,Fe_{(3-x-y)}\,O_4\ (0<x,\ y<3)$$

or, when the Cr is partially substituted by Mn, $$Cr_{x1}Mn_{x2}Ni_y\,Fe_{(3-x1-x2-y)}\,O_4\ (0<x1,\ x2,\ y<3)$$

The tube elements may also have 0.2–10 wt % of cobalt (Co) added. In this case the composition of the black film oxide is representable by the chemical formula $$Cr_x\,Ni_y\,Co_z\,Fe_{(3-x-y-z)}\,O_4\ (0<x,\ y,\ z<3)$$

or $$Cr_{x1}Mn_{x2}Ni_y\,Co_z\,Fe_{(3-x-y-z)}\,O_4\ (0<x1,\ x2,\ y,\ z<3)$$

and has a spinel structure.

A Cr rich layer is produced on a surface on which a black film is formed and this contributes to film adhesion strength. Designating the thickness of the Cr rich layer as a, it is satisfactory if it is made such that relative to the black film thickness b it is $$0<a\leqq(\tfrac{3}{4})b$$

Though the range of the grain size of the tube elements is subject to restrictions connected with the workability of plate elements if the size is too small, the smaller the average grain diameter the rougher the surface, which is desirable from the point of view of heat radiation, although if the average diameter is too small formability is poorer. For practical purposes, therefore, the material is material in which the average number of crystal grains per 1 $mm^2$ is 10–9000.

The reason for making the Ni component 25–45 wt % is to make the coefficient of thermal expansion $90\times10^7$/°C. or less. If the Ni addition is outside the above range, it is not possible to produce tube elements with the low coefficient of thermal expansion that is the object of the invention and so it is not possible to obtain an attractive image with a low PD value. If the Ni addition exceeds 45 wt %, the result is an increase in the 0.2% proof strength, which is a criterion of the quality of formability, and the formability is much poorer. Also, springback, for example, occurs in the shadow mask, making it difficult to obtain a clear image. At the same time, it normally becomes difficult to effect blackening treatment of its surface because of an increase in its resistance to oxidation.

With regard to etching too, large Ni contents make fine etching difficult and result in problems such as the fact that so-called gas pitting occurs in the side walls of etching holes or that the etching speed is reduced because of large amounts of Ni being dissolved and entering the etching solution.

Cr raises the coefficient of thermal expansion of Fe-Ni alloys but on the other hand it lowers the 0.2% proof strength, so contributing considerably to formability. Thus, addition of Cr does not result in as much worsening of the PD value as conventional invar but it plays an important role in improving formability, especially in cases in which shadow masks with a large curvature, etc. are produced.

However, with a Cr addition of less than 0.3 wt %, the 0.2% proof strength does not fall to the practically useful region of 22 kg/mm$^2$ or less, while if the amount of Cr and, if required, Mn that is added exceeds 10 wt %, there can be difficulties in formation of black film on the surfaces of tube elements.

This addition range also applies in cases in which 0.2–10%, preferably 7% or less of Co is added to Fe-Ni alloys. Addition of Co in the abovenoted range lowers the coefficient of thermal expansion still further and can improve etchability. Also, the black film containing Co that is formed has excellent blackness, adhesion and hardness properties.

DETAILED DESCRIPTION OF PREFERRED EMBODIMENTS

Example 1

Figure 1:
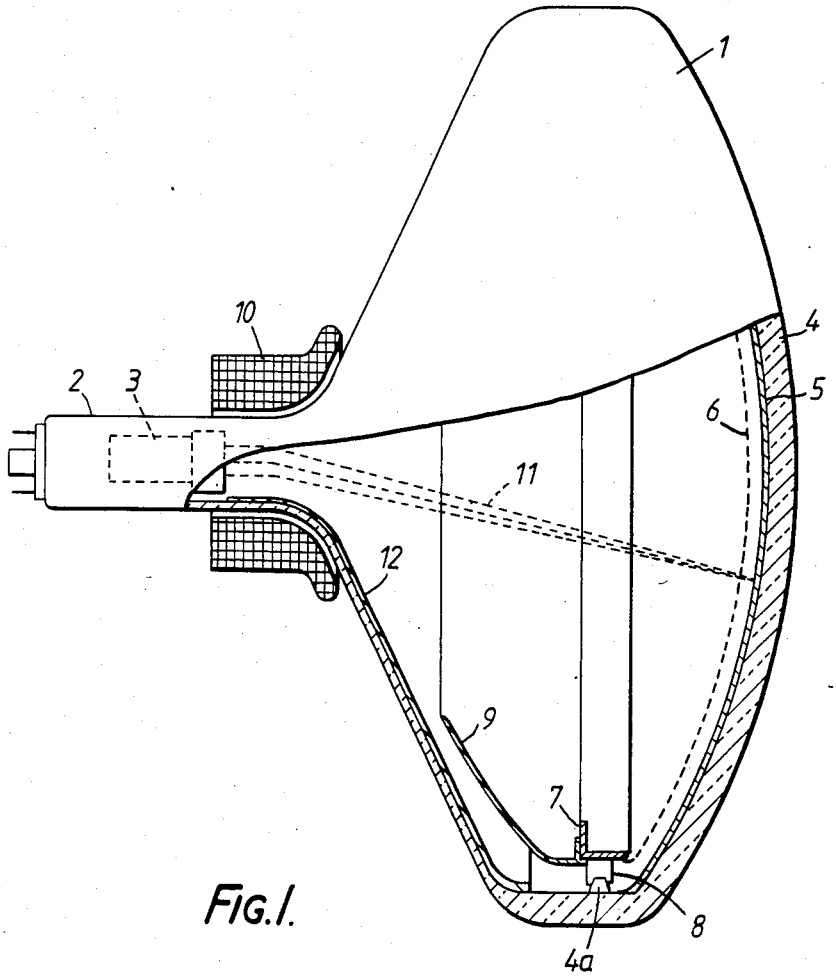
FIG. 1 is a cross-sectional view, partially cutaway, showing one embodiment of the invention.

Referring to FIG. 1, in one embodiment of the invention, electron guns 3, e.g., in an in-line array, are provided in a neck portion 2 defined by one end of a glass envelope 1 and a fluorescent surface 5 on which red, blue and green phosphors are provided in a picture-division array is provided on a face portion 4 at the other end of the envelope 1 facing the electron guns 3. A shadow mask 6 with many beam holes faces and is near to the fluorescent surface 5. The periphery of this shadow mask 6 is spot welded to a frame 7. As this frame 7 is mounted on panel pins 4*a* of the inside wall of the face portion 4 by attachment elements 8 including bimetal material, it is fitted with an inner shield 9 to shield it from the effects of earth magnetism.

In a colour picture tube thus constructed, three electron beams 11 emitted by the electron guns 3 are subject to the deflection control of and are deflected by a deflection device 10 provided at the root portion of the neck portion 2 and pass through holes of the shadow mask to strike the fluorescent surface 5 and cause fluorescence and so produce a coloured image.

Manufacture of the shadow mask 6 is as follows. First, an ingot of an alloy containing 36% Ni and Fe as main components, 6 wt % Cr and, as supplementary components, 0.01 wt % each of C and Si and 0.005 wt % each of P and S was prepared and this ingot was made into 0.13 mm thick sheet material by repeated annealing and cold working. Next, the sheet material was coated with photoresist and after this had been dried, mask defining a standard pattern in the form of slots or dots was adhered to both sides of the sheet material and the photoresist was exposed and developed, this development resulting in unexposed portions of the photoresist being dissolved and removed. Next, the remaining photoresist was hardened by burning, etching treatment with a ferric chloride solution was effected and then the remaining resist was removed with hot alkali, so producing a flat mask constituting an original sheet for a shadow mask.

Next, after washing and shearing treatment, this flat mask was vacuum annealed at $10^{-4}$ torr, 1000° C. and subjected to press working to give a formed mask with a radius of curvature of 1000 mm. After acid treatment of this formed mask, washing with triclene and washing with water, heating oxidation was effected for 30 minutes at 670° C. in a moist 30% $O_2$-$N_2$ atmosphere. The number of crystal grains in the resulting mask was 300 per 1 mm$^2$ and the Cr rich layer had a Cr concentration of 10 wt % and was 0.6 $\mu$m thick.

Figure 2:
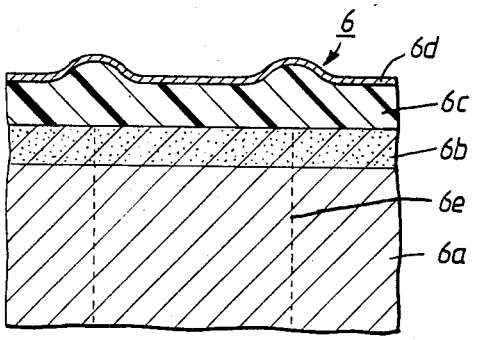
FIG. 2 is an enlarged cross-section of a portion of a shadow mask in one embodiment of the invention.

In the shadow mask 6, an Fe-Ni alloy plate body 6*a* has a Cr rich layer 6*b* formed on its outer surface side and black film 6*c* is formed on the outer surface of this, as shown in FIG. 2. The black film 6*c* is produced as the result of annealing and oxidation of the plate body 6*a* and has a spinel structure representable by the chemical formula $$Cr_x Ni_y Fe_{(3-x-y)} O_4 \ (0<x,\ y<3)$$

On top of that, there may further be very thin formation of $\alpha$-$Fe_2O_3$ 6*d*, this being not more than 1/5 of the film 6*c*, but as this is on top of the black film 6*c*, there is no peeling and it does not effect the degree of blackness.

The black film 6*c* on the crystal grain boundary 6*e* of the plate body 6*a* builds up to form peaks but this is advantageous for radiation of heat since it increases the surface area of the film. As long as annealing in moist hydrogen is not effected, the crystal grains of the black film depend on the crystal grains inside the alloy. Fine grains are better from the point of view of the black film but coarse grains are better from the point of view of formability. The crystal grain treatment temperature varies but for the shadow mask the grain number is suitably 10–9000 and preferably it is made 50–5000 per 1 mm$^2$ and the black film produced is made more uneven.

The black film can be adhered more firmly if, designating the thickness of the Cr rich layer 6*b* as a, the mask annealing and oxidation treatment are effected in a manner such that this thickness is in the relation $$0<a\leqq(\tfrac{3}{4})b$$

to the thickness b of the black film 6c.

Formation of the Cr rich layer 6b is the result of the above treatment and its average Cr concentration n2 is in the relation $$10\ n1 \geqq n2 \geqq 1.2\ n1$$

to the Cr addition n1 in the alloy plate body 6a, n2 being taken to be 50 wt % or less.

The shadow mask thus produced was attached by spot welding to a frame manufactured by similar procedure and this was mounted on a panel via bimetal material. Next, red, blue and green phosphors are applied in correspondence to the holes of the shadow mask and after Al deposition and aquadag coating, an inner shield was mounted, the funnel in the rear portion of an envelope fitted with electron guns and the face portion of the envelope were connected and sealed and the interior was evacuated, so giving a colour picture tube. The inner shield, also, was made of similar material.

Figure 3:
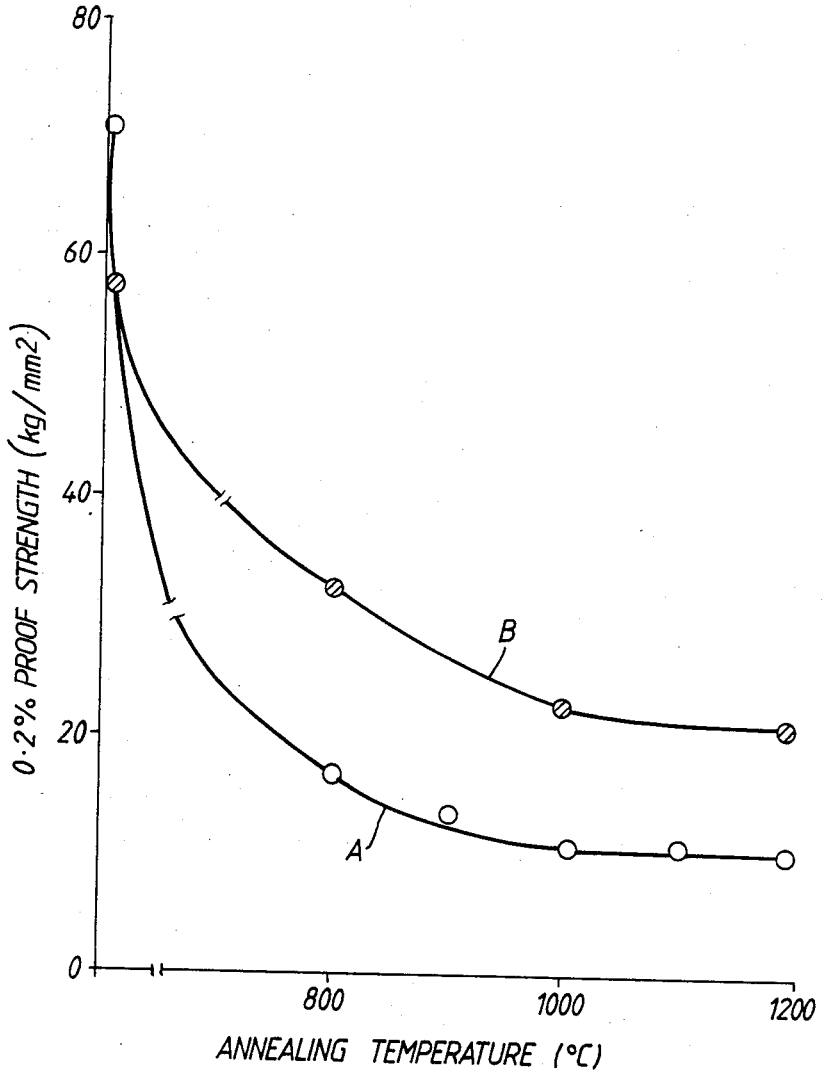
FIG. 3 is a graph showing the relation between annealing temperature and 0.2% proof strength for the purpose of explaining the invention.

In FIG. 3, the variation of 0.2% proof strength with annealing temperature of a 36 Ni-Fe alloy with addition of 6 wt % Cr constituting material according to this embodiment is plotted as characteristic A. As the 0.2% proof strength indicates stretcher at 0.2% strain on the stretcher strain curve, it constitutes a standard indicative of the strength of material. Characteristic B is the variation of 0.2% proof strength with annealing temperature in a 36 Ni-Fe alloy without Cr addition that is given for comparison. It is seen from the figure that the 0.2% proof strength of tube element material according to the invention is higher than that of conventional material at room temperature but is considerably lower when annealing is effected at a temperature of 500° C. or more. For example, when vacuum annealing is effected at 1000°–1200° C. the 0.2% proof strength of tube element material according to the invention is 12 kg/mm$^2$ but that of material without Cr addition is higher, at about 22 kg/mm$^2$. It is seen from this that addition of Cr makes a considerable contribution to lowering of the 0.2% proof strength. An element that displays the same effect as that of Cr addition is Mn and it is therefore possible to partially substitute the Cr with Mn. In this case the oxide film produced has a $Cr_{x1}Mn_{x2}Ni_y Fe_{(3-x1-x2-y)} O_4$ ($0<x1, x2, y<3$) spinel structure. This Cr addition is also effective with a super-invar containing 30–35% Ni and up to 7% Co.

A colour picture tube was assembled using a shadow mask in which a 20" flat mask formed with material indicated by the above characteristic A was hydrogen annealed at 800° C. and then had a black oxide film formed on its surface by steam oxidation. Measurement of the PD value of this tube over a 3 minute period showed it to be the small value of 95 μm. In contrast, when the same measurement was made for a shadow mask for which conventional invar was used, it was found impossible to determine the PD value because of marked springback of the shadow mask and extreme unevenness of colour.

If, however, the Cr addition is less than 0.3 wt %, as with 36 Ni-Fe alloys without Cr addition the 0.2% proof strength does not go to 20 kg/mm$^2$ or less even if the annealing temperature is as high as 1200° C. If the amount added exceeds 10 wt %, the coefficient of thermal expansion becomes $90\times10^{-7}$/°C. or more, which, since it causes colour fringing, makes the material unsuitable for use in high definition colour picture tubes. Further a Cr addition exceeding 10 wt % gives rise to drawbacks in connection with blackening treatment since a $Cr_2O_3$ protective film is liable to be formed on the surface of the material and the speed of surface blackening is liable to be slow.

Figure 4:
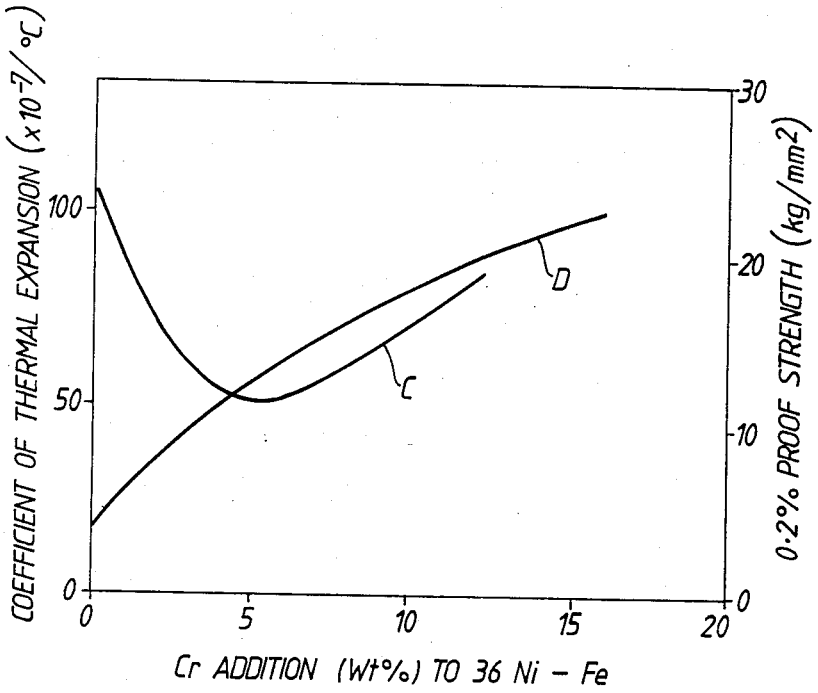
FIG. 4 is a graph showing the relations between the amount of Cr added and the 0.2% proof strength and annealing temperature for the purpose of explaining the invention.

As seen in FIG. 4, in which the 0.2% proof strength variation characteristic C and the thermal expansion coefficient variation characteristic D when a shadow mask formed using tube element material according to the invention is annealed at 1000° C. in hydrogen are plotted taking the amount of Cr added as a parameter, the 0.2% proof strength is kept to 22 kg/mm$^2$ or less and springback can be prevented as a result of this annealing if the Cr addition is made 0.5–15 wt %. With a Cr addition of over 10 wt %, however, as well as the 0.2% proof strength rising there is also a rise in the coefficient of thermal expansion, which is a cause of variation of the PD value. It is therefore necessary to restrict the Cr addition to 0.3–10 wt % as described above.

A past example of addition of Cr to a 36 Ni-Fe alloy in order to produce tube element material of high strength is that of Japanese laid-open Patent Application No. 59-58977. However, this includes no measures at all for achieving low proof strength and the resulting material is simply high strength material and is not designed for reduced 0.2% proof strength. Also, as described below, a surface black oxide film fails to form and instead there is an $\alpha$-$Fe_2O_3$ film which peels off easily. If one considers these points, therefore, it can be said to be completely different from tube element material according to the invention.

The above blackening film 6c formed on the material's surface plays an important role in connection with improvement of heat radiation and contributes greatly to lowering of the PD value of a colour picture tube. Radiation of heat is determined by the degree of blackness and by the surface roughness and a blackening film 6c according to the invention is superior with respect to the following points.

Unlike a blackening film formed on conventional Al killed steel or rimmed steel, a blackening film constituted by $Cr_x Ni_y Fe_{3-x-y} O_4$ ($0<x, y<3$) has a spinel type oxide structure in which some of the Fe sites are substituted by Cr or Ni. With this $Cr_x Ni_y Fe_{3-x-y} O_4$, there are not liable to be voids inside the film due to gas or vacancies and the film displays excellent adhesion to the base material. Since, also, it has high hardness, it is effective in preventing sustained resonating noise caused by vibration. Inside a colour picture tube, the blackening layer 6c is not liable to peel off, because Cr accumulates at the metal/oxide boundary, and so there is no risk of electron guns being damaged by detached fragments. Further, acicular (needle-shaped) crystals tend to be formed normal to the mask surface, so giving still better radiation of heat.

There is no change in characteristics even if there is infiltration or solid solution of unavoidable components in the $Cr_x Ni_y Fe_{3-x-y} O_4$. This is known from the fact that when Cr is added to super-invar containing 30–35% Ni and up to 7% Co, there is solid solution of Co in its blackening film but no change in its characteristics. When the material is one in which Cr is partially substituted by Mn, the blackening film has a spinel structure constituted by $Cr_x Mn_y Ni_z Fe_{3-x-y-z} O_4$ and the same effects are displayed in this case too. However, unlike Cr, Mn is uniformly dispersed in the oxide film in most cases. When air oxidation or steam oxidation are used in formation of this blackening film, $\alpha$-$Fe_2O_3$ is formed on the surface but this does not cause any problems as it is an extremely thin film.

A comparison of the PD values of 20" colour pictur tubes assembled using a shadow mask of the above noted material on whose surface a blackening film with a composition as noted above was formed and a shadow mask on which no blackening film was formed showed that whereas the 3 minute PD value in the case of the element with no blackening film was 120–130 μm, the PD value with the element which did have a blackening film formed on it was small, at 80 μm. Thus, the blackening film acts to improve the heat radiation action and is very effective in suppressing PD. These effects are particularly marked when a flattened shadow mask with a curvature of 900 mm or more is formed.

EXAMPLE 2

A flat mask was manufactured in the same way as in Example 1 using an ingot of an alloy containing 36% Ni and Fe as main components, 2 wt % Cr and, as supplementary components. 0.01 wt % each of C and Si and 0.005 wt % each of P and S. Then, this flat mask was hydrogen annealed at 1000W° C. to give a shadow mask which was oxidized in steam for 10 minutes at 650° C. and 20 minutes at 680° C. The number of crystal grains of this shadow mask was 600 per 1 $mm^2$. The Cr rich layer had a Cr concentration of 5 wt % and was 0.5 μm thick. A colour picture tube was produced using this shadow mask. The oxide was 1.2 μm thick.

EXAMPLE 3

A flat mask was manufactured in the same way as in Example 1 using an ingot of an alloy containing 36% Ni and Fe as main components, 4 wt % Cr and, as supplementary components, 0.01 wt % each of C and Si and 0.005 wt % each of P and S. Then, a shadow mask was produced by hydrogen annealing of this flat mask at 800° C. and formation of a black oxide film in the same conditions as in Ex. 2. The number of crystal grains of this shadow mask was 2100 per 1 $mm^2$ and the Cr rich layer had a Cr concentration of 8 wt % and was 0.5 μm thick and the black film was 1.3 μm thick. A colour picture tube was produced using this shadow mask.

Investigation of the PD value at the four corners of the colour picture tubes of Examples 1–3 thus produced showed that it was the small value of about 80–90 μm. as opposed to the value of 120–130 μm in conventional 20" units. Also, the time required to return to a normal state after occurrence of PD was about half (around 2 minutes 30 seconds) that required conventionally. Further, there was no colour fringing and a very fine, high quality image was obtained over the whole screen.

EXAMPLE 4

An ingot of an alloy containing 32% Ni and Fe as main components, 5 wt % Co, 2 wt % Cr and, as supplementary components, 0.01 wt % each of C and Si and 0.005 wt % each of P and S was prepared and this ingot was made into 0.13 mm thick sheet material by repeated annealing and cold working. Next, the sheet material was coated with photoesist and after this had been dried, film defining a standard pattern in the form of slots or dots was adhered to both sides of the sheet material and the photoesist was exposed and developed, this development resulting in unexposed portions of the photoresist being dissolved and removed. Next, the remaining photoresist was hardened by burning, etching treatment with a ferric chloride solution was effected and then the remaining resist was removed with hot alkali, so producing a flat mask constituting an original sheet for a shadow mask.

Next, after washing and shearing treatment, this flat mask was vacuum annealed at $10^{-4}$ torr 1150° C. The coefficient of thermal expansion at this time was $22\times10^{-7}$/°C. and the 0.2% proof strength was 21 kg/$mm^2$. Next, press working was effected to give a formed mask with a radius of curvature of 1000 mm. After acid treatment of this formed mask, washing with triclene and washing with hater, heating oxidation was effected for 30 minutes at 730° C. in a 30% $O_2$ - N moist atmosphere. The number of crystal grains at this time was 100 per 1 $mm^2$ and the Cr rich layer had a Cr concentration of 5.7 wt % and was 1.0 μm thick and the black film was 1.4 μm thick.

The shadow mask thus produced was attached by spot welding to a frame manufactured by similar procedure and this was mounted on a panel via bimetal elements. Next, red, blue and green phosphors were applied in correspondence to the holes of the shadow mask and after A1 depositon and aquadag coating, an inner sheild was mounted, the funnel in the rear portion of an envelope fitted with electron guns and the face portion of the envelope were connected and sealed and the interior was evacuated, so giving a colour picture tube. The inner shield, also, was made of similar material.

Addition of Co as well as Cr has the effect of improving etchability and lowering the coefficient of thermal expansion. Etching becomes more difficult as the Cr concentration increases unless the number of crystal grains is set at 2000–32000 per 1 $mm^2$ but if Co is added etching is possible without this grain size specification necessarily having to be met. Further, etching is possible without the direction of crystals on rolled surfaces necessarily having to be concentrated in the (100) direction. The coefficient of thermal expansion becomes smaller with increased Co and is minimum with a 5 wt % addition. The reason why the Co content is made 0.2–10 wt % is that the effects noted above fail to be achieved if it is out of this range.

The aboenoted blackening film formed on the surface of the material plays an important role in connection with improvement of heat radiation by the material and contributes greatly to lowering of the PD value of a colour picture tube. Radiation of heat is determined by the degree of blackness and by the surface roughness and a blackening film according to the invention is superior with respect to the following points.

Unlike a blackening film formed on conventional Al killed steel or rimmed steel, a blackening film constituted by $Cr_x Ni_y Co_z Fe_{(3-x-y-z)} O_4 (0<x, y, z<3)$ has a spinel type oxide structure in which some of the Fe sites are substituted by Co, Cr or Ni.

With this $Cr_x Ni_y Co_z Fe_{(3-x-y-z)} O_4$, there are not liable to be voids inside the film due to gas or vacancies and the film displays excellent adhesion to the base material. Since, also, it has high hardness, it is effective in preventing sustained resonating noise caused by vibration. Inside a colour picture tube, the abovenoted blackening layer is not liable to peel off, because Cr accumulates at the metal/oxide boundary, and so there is no risk of electron guns being damaged by detached fragments. Further, acicular crystals tend to be formed normal to the mask surface, so giving still better radiation of heat. The Co is in uniform solid solution in the blackening film and serves to improve the film's hardness.

The material may be material in which the Cr is partially substituted by Mn and in this case the blackening film has a spinel structure consisting of $Cr_{x1}Mn_{x2}Ni_y Co_z Fe_{(3-x1-x2-y-z)} O_4$ ($0<x1, x2, y, z<3$). There are the same effects in this case too. However, unlike Cr, Mn is uniformly dispersed in the oxide film in most cases. When air oxidation or steam oxidation are used in formation of this blackening film, $\alpha$-$Fe_2 O_3$ is formed on the surface but this does not cause any problems as it is an extremely thin film.

A comparison of the PD values of colour picture tubes assembled using a shadow mask of the abovenoted material on whose surface a blackening film with a composition as noted above was formed and a shadow mask on which no blackening film was formed showed that whereas the 3 minute PD value in the case of the element with no blackening film was 120–130 μm, the PD value with the element which did have a blackening film formed on it was small, at 80 μm. Thus, the blackening film acts to improve the heat radiation action and is very effective in suppressing PD. These effects are particularly marked when a flattened shadow mask with a radius of curvature of 900 mm or more is formed.

EXAMPLE 5

A flat mask was manufactured in the same way as in Example 4 using an ingot of an alloy containing 30% Ni and Fe as main components, 2 wt % Co, 2 wt % Cr and, as supplementary components, 0.01 wt % each of C and Si and 0.005 wt % each of P and S and this flat mask was hydrogen annealed at 1150° C. The coefficient of thermal expansion at this time was $45°\times10^{-7}$/°C. and the 0.2% proof strength was 19 kg/mm$^2$. The flat mask with these properties was molded to give a shadow mask. The number of crystal grains and the Cr rich state were more or less the same as in Ex. 4. A colour picture tube was produced using this shadow mask.

EXAMPLE 6

A flat mask was manufactured in the same way as in Example 4 using an ingot of an alloy containing 32% Ni and Fe as main components, 5 wt % Co, 4 wt % Cr and, as supplementary components, 0.01 wt % each of C and Si and 0.005 wt % each of P and S and this flat mask was hydrogen annealed at 900° C. The coefficient of thermal expansion at this time was $35\times10^{-7}$/°C. and the 0.2% proof strength was 16.0 kg/mm$^2$. The flat with these properties was molded to give a shadow mask and this was used in production of a colour picture tube.

EXAMPLE 7

First, an ingot of an alloy containing 36 wt % Ni and Fe as main components, up to 1 wt % each of C, Si, P, S, Zn, Cu, O, B and Ca as supplementary components, 3 wt % Mn and 2 wt % Cr was prepared and this alloy ingot was made into 0.13 mm thick sheet material by repeated annealing and cold working. This was followed by coating of this sheet material with a photosensitive agent, exposure, development and etching by burning, to give flat mask stock material, which was then washed and sheared and then annealed at 900° C. in hydrogen and subjected to press working to give a formed mask with a radius of curvature of 1000 mm. This formed mask was given heating oxidation treatment for 30 minutes at 620° C. in a 30% $O_2$—$N_2$ moist atmosphere. The number of crystal grains was 1200 per 1 mm$^2$ and the Cr rich film had a Cr concentration of 3.8 wt % and was 0.7 μm thick and the black film was 1.2 μm thick. The PD value was 90 μm. The shadow mask thus produced had a low springback value too.

EXAMPLE 8

An alloy ingot containing 40 wt % Ni and Fe as main components, up to 1 wt % each of C, Si, P, S, Zn, Cu, O, B, and Ca as supplementary components, 1 wt % Mn, 5 wt % Cr and 2 wt % Co was prepared and, using this alloy ingot, a colour picture tube was constructed by the same steps as in Example 1. The PD value was 100 μm.

Investigation of the PD value at the four corners of the colour picture tubes of Examples 4–6 produced in the abovedescribed manner showed that it was the small value of about 70–80 μm, as opposed to the value of around 120–130 μm in conventional 20" colour picture tubes. Also, the time required to return to a normal state after occurrence of PD was about half (around 2 minutes 30 seconds) that required conventionally. Further, there was no colour fringing and a very fine, high quality image was obtained over the whole screen. Also, there was no unevenness of colour on the screen since there were no gas holes in the etching holes.

Although description was given above taking formation of shadow masks as an example, it also possible to produce colour picture tubes in which the inner shields or frames or bimetal elements, etc. are manufactured in a similar way.

What is claimed is:

1. A color picture tube comprising:

(a) a tube element composed of an Fe-Ni alloy comprising Fe as its main component, and at least some Cr;

(b) a Cr-rich layer formed on the surface of said tube element, wherein said Cr-rich layer has a Cr content of 1.2 to 10 times that of the Cr content of said tube element; and (c) a black oxide film formed on the surface of said Cr-rich layer, wherein said black oxide film has a spinel structure and is represented by chemical formula $$Cr_x Ni_y Fe_{(3-x-y)} O_4$$

wherein ($0<x, y<3$).

2. A color picture tube as claimed in claim 1, wherein a portion of said Cr is substituted by Mn.

3. A color picture tube as claimed in claim 2, wherein said black oxide film is represented by chemical formula $$Cr_{x1}Mn_{x2}Ni_y Fe_{(3-x1-x2-y)} O_4$$

wherein ($0<x1, x2, y<3$).

4. A color picture tube as claimed in claim 3, wherein said Cr-rich layer has a thickness (a) which is related to the thickness (b) of said black oxide film such that $$0<a\leqq(\tfrac{3}{4})b.$$

5. Color picture tube as claimed in claim 1, wherein said tube element is an Fe alloy in which the crystal grain number is 10–9000 per 1 mm$^2$.

6. Color picture tube as claimed in claim 1, wherein said tube element is at least one of the element consisting of a shadow mask, frame, inner shield and bimetal element.

7. A color picture tube as claimed in claim 1, wherein said Fe-Ni alloy comprises:

25–45 wt % Ni, 0.2–10 wt % Co,

0–10 wt % Mn, and at least some Cr.

8. A color picture tube as claimed in claim 7 wherein a portion of said Cr in said black oxide film is substituted by Mn.

9. A color picture tube as claimed in claim 8, wherein said black oxide film is represented by chemical formula $$Cr_xNi_yCo_zFe_{(3-x-y-z)}O_4$$

wherein ($0<x, y, z<3$) or $$Cr_{x1}Mn_{x2}Ni_yCo_zFe_{(3-x1-x2-y-z)}O_4$$

wherein ($0<x1, x2, y, z<3$).

* * * * *